United States Patent [19]

Shimono et al.

[11] 4,237,816

[45] Dec. 9, 1980

[54] OIL COATER FOR MAT

[75] Inventors: Kikuo Shimono, Takatsuki; Ichiro Miyoshi, Kobe; Osamu Yamasaki, Kaizuka, all of Japan

[73] Assignee: Duskin Franchise Co., Ltd., Osaka, Japan

[21] Appl. No.: 956,405

[22] Filed: Oct. 31, 1978

[51] Int. Cl.[3] ..... B05C 1/02

[52] U.S. Cl. ..... 118/249; 118/259; 118/262

[58] Field of Search ..... 118/249, 258, 259, 262, 118/239, 250

[56] References Cited

U.S. PATENT DOCUMENTS

| | | | |
|---|---|---|---|
| 1,552,295 | 9/1925 | Hampson | 118/249 X |
| 1,973,316 | 9/1934 | Hormel | 118/262 |
| 2,108,389 | 2/1938 | Paul | 118/262 X |
| 3,097,968 | 7/1963 | Schaefer | 118/259 |
| 3,146,159 | 8/1964 | Muggleton | 118/262 X |
| 3,468,286 | 9/1969 | Nugarus | 118/259 X |

*Primary Examiner*—John P. McIntosh
*Attorney, Agent, or Firm*—Sherman & Shalloway

[57] ABSTRACT

An oil coater for mats which comprises a mat-supporting moving surface, a coating roller disposed above said mat-supporting moving surface and having on the periphery thereof a foam layer capable of being impregnated with an oiling composition, a press roller having a diameter smaller than the diameter of said coating roller and having on the periphery thereof a foam layer capable of being impregnated with an oiling composition, a first bearing mechanism which supports said press roller at a position upstream of said coating roller so that the top face of said press roller is substantially on the same horizontal plane with the top face of said coating roller and the degree of pressed contact between said coating roller and said press roller can be adjusted, a mat-feeding roller disposed below said mat-supporting moving surface, a second bearing mechanism which supports said feeding roller so that the axis of said feeding roller is substantially on the same vertical plane with the axis of said coating roller and the gap between said feeding roller and said coating roller can be adjusted, a pair of confronting dam plates arranged to form an oil reservoir on the surfaces of said coating roller and said press roller through seal portions above the contact position of said two rollers, an oil feed mechanism for supplying an oiling composition to said oil reservoir, a mechanism for controlling the level of the oiling composition in said oil reservoir and a driving mechanism for driving said coating roller and said feeding roller, wherein the amount of the oiling composition coated on the mat can be controlled by adjusting the degree of pressed contact between said coating roller and said press roller and the gap between said coating roller and said feeding roller.

5 Claims, 6 Drawing Figures

OIL COATER FOR MAT

BACKGROUND OF THE INVENTION (1) Field of the Invention

The present invention relates to an oil coater for mats. More particularly, the invention relates to an oil coater for a duster mat to be used at the entrance or the like to remove dusts adhering to shoe soles and prevent them from being brought into the interior of a room, which can coat an oiling composition to the pile surface of the duster mat uniformly in a controlled small amount.

(2) Description of the Prior Art

As such duster mats, there have been broadly used products prepared by tufting or electrostatically planting fiber bundles or piles to a fibrous base fabric or plastic net, supporting the back side with a latex of a synthetic resin, a rubber or the like to form a backing layer and impregnating the fiber bundles or piles with an oiling composition. The amount of the oiling composition to be applied to fiber piles should be such that the oiling composition does not substantially migrate to articles such as shoes but dusts adhering to shoes can be effectively attracted to the pile surface and retained therein. Accordingly, it is important that the oiling composition should be coated to the pile surface uniformly in a controlled small amount.

There are known various methods for coating a dust-adsorbing oiling composition to fibers. A most popular method is one comprising dipping fibers in an aqueous emulsion of a self-emulsifiable and self-exhausting oiling composition to make the oiling composition adsorbed in the fibers. According to this method, the oiling composition is applied also to the backing layer of the mat to damage it. Further, post treatments such as dehydration and drying are complicated. Accordingly, this method is still insufficient from the viewpoints of the process steps and the quality of the product.

As another means for coating an oiling composition to the fiber pile surface, there can be considered a spray coating method and a roller coating method. However, the former method involves problems of environmental pollution by mists of the oiling composition, and cares should be taken for the operation safety. According to the latter method, although satisfactory results can be obtained when the oiling composition is applied to a smooth and even surface, it is difficult to coat the oiling composition uniformly in a controlled small amount to a surface having various irregular convexities and concavities, such as of fiber piles of a mat.

OBJECTS OF THE INVENTION

It is therefore a primary object of the present invention to provide a coating apparatus in which an oiling composition can be coated on fiber piles of a duster mat effectively and uniformly in a controlled small amount by means of a roller.

Another object of the present invention is to provide an oil coater for a duster mat in which the amount of an oiling composition coated to fiber piles of the mat can be adjusted in a relatively broad range without substantial reduction of uniformity in the coating to the fiber piles.

Still another object of the present invention is to provide an oil coater for duster mats which can coat a controlled amount of an oiling composition to each of duster mats being intermittently fed without loss of the oiling composition or variation of the coated amount of the oiling agent.

A further object of the present invention is to provide an oil coater for duster mats which has a relatively simple structure and can be maintained and inspected very easily.

SUMMARY OF THE INVENTION

In accordance with the present invention, there is provided an oil coater for mats which comprises a mat-supporting moving surface, a coating roller disposed above said mat-supporting moving surface and having on the periphery thereof a foam layer capable of being impregnated with an oiling composition, a press roller having a diameter smaller than the diameter of said coating roller and having on the periphery thereof a foam layer capable of being impregnated with an oiling composition, a first bearing mechanism which supports said press roller at a position upstream of said coating roller so that the top face of said press roller is substantially on the same horizontal plane with the top face of said coating roller and the degree of pressed contact between said coating roller and said press roller can be adjusted, a mat-feeding roller disposed below said mat-supporting moving surface, a second bearing mechanism which supports said feeding roller so that the axis of said feeding roller is substantially on the same vertical plane with the axis of said coating roller and the gap between said feed roller and said coating roller can be adjusted, a pair of confronting dam plates arranged to form an oil reservoir on the surfaces of said coating roller and said press roller through seal portions above the contact position of said two rollers, an oil-feeding mechanism for supplying an oiling composition to said oil reservoir, a mechanism for controlling the level of the oiling composition in said oil reservoir and a driving mechanism for driving said coating roller and said feeding roller, wherein the amount of the oiling composition coated on the mat can be controlled by adjusting the degree of pressed contact between said coating roller and said press roller and the gap between said coating roller and said feeding roller.

DETAILED DESCRIPTION OF THE PREFERRED EMBODIMENTS

The present invention will now be described in detail by reference to the embodiments illustrated in the accompanying drawing.

Figure 1:
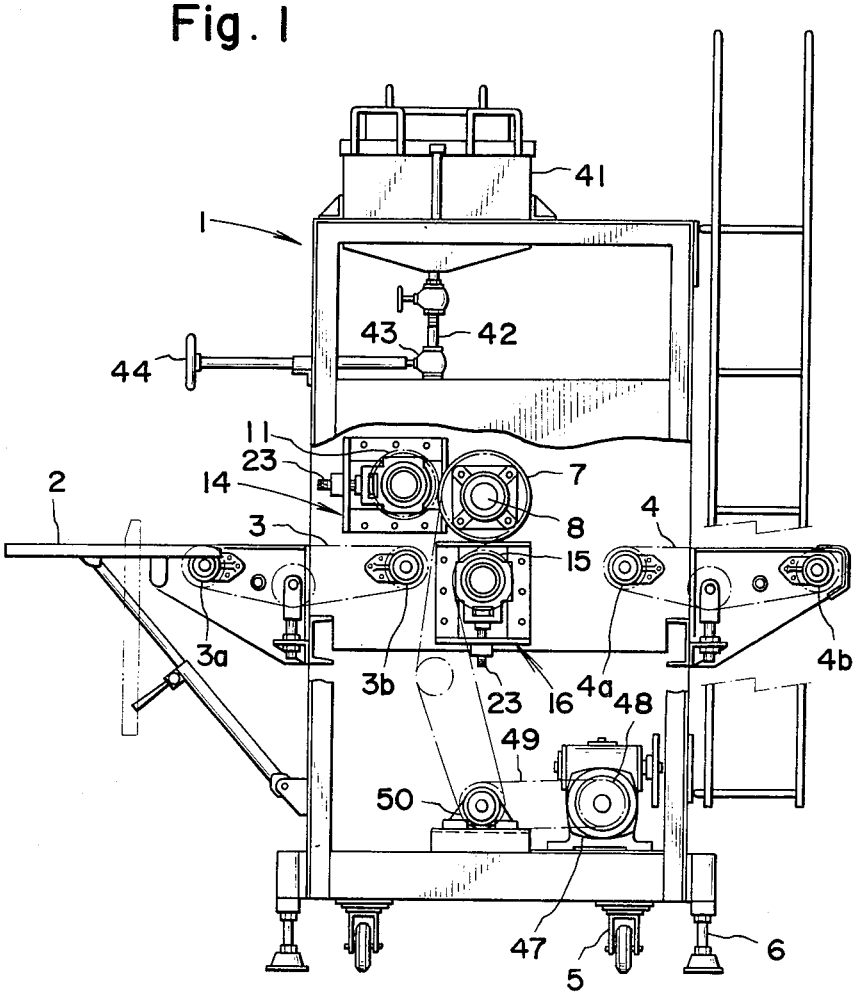
FIG. 1 is a side view illustrating the arrangement of one embodiment of the apparatus of the present invention.
Figure 2:
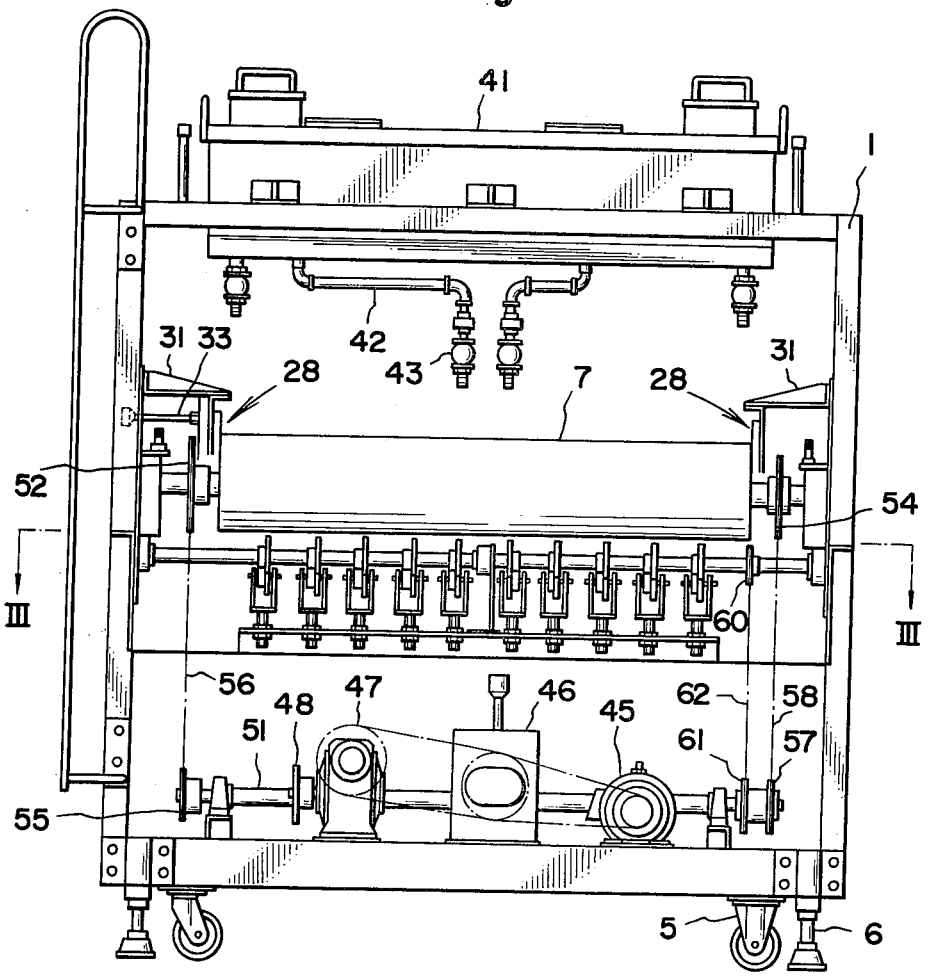
FIG. 2 is a front view of the apparatus of FIG. 1 seen from the discharge side.
Figure 3:
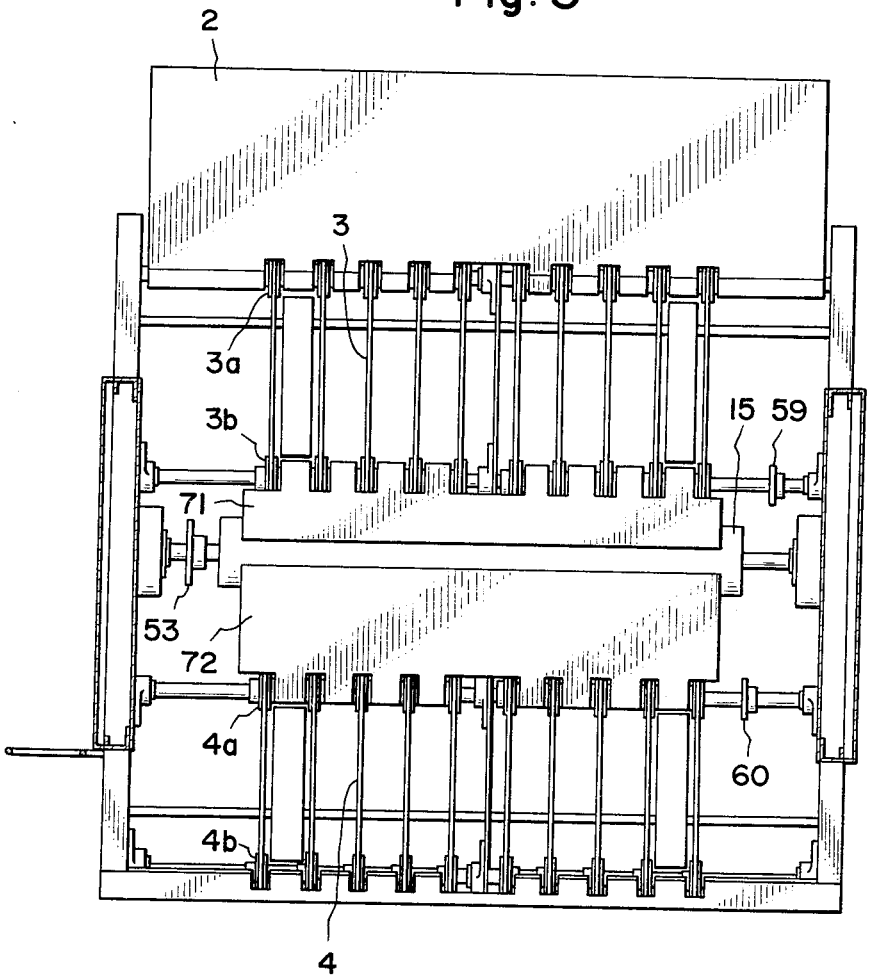
FIG. 3 is a plan view showing the section taken along the line III—III in FIG. 2.

Referring to FIGS. 1 to 3 illustrating the entire structure of the oil coater of the present invention, a mat-feeding table 2 is disposed on a machine frame 1 on the mat-feeding side, and a plurality of lines of mat-feeding belts 3 and a plurality of lines of mat-discharging belts 4 are supported by pulleys *3a* and *3b* and pulleys *4a* and *4b*, respectively, to form a mat-supporting moving surface. Guide plates 71 and 72 are disposed along this supporting moving surface. Moving wheels 5 and adjustable legs 6 may be mounted on the machine frame 1 so that the oil coater can be moved and stopped at an optional position for the coating operation.

Figure 4:
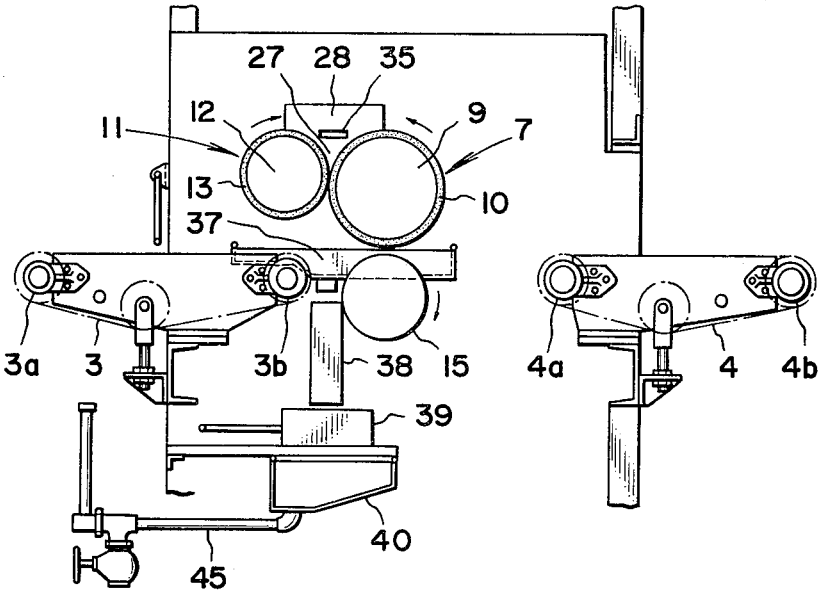
FIG. 4 is a partial sectional side view showing the oil reservoir and oil circulation system in the apparatus of FIG. 1.

Above the mat-supporting moving surface defined by the belts 3 and 4, an oil-coating roller 7 is disposed in the state supported by an appropriate bearing 8. As shown in FIG. 4, the coating roller 7 comprises a shaft 9 of steel and a foam layer 10 mounted on the periphery of the shaft 9. This foam layer 10 is capable of being impregnated with an oiling composition.

A press roller 11 is disposed so that it has press contact with the coating roller 7 in the similar horizontal direction. The diameter of this press roller 11 is smaller than that of the coating roller 7. As shown in FIG. 4, the press roller 11 comprises a shaft 12 of steel and a foam layer 13 mounted on the periphery thereof. The foam layer 13 is capable of being impregnated with an oiling composition. This press roller 11 is disposed and supported on the machine frame 1 by a bearing mechanism entirely indicated by reference numeral 14 so that the top face of the press roller 11 is substantially on the same plane with the top face of the coating roller 7, the press roller 11 is located in the upstream (on the mat-feeding side) of the coating roller 7 and that the degree of pressed contact between the two rollers 7 and 11 can be adjusted by a mechanism described hereinafter.

On the lower side of the mat-supporting moving surface, there is disposed a mat-feeding roller 15 and is supported by a bearing mechanism entirely indicated by reference numeral 16 so that the axis of the roller 15 is substantially on the same vertical plane with the axis of the coating roller 7 and the gap between the two rollers 7 and 15 can be adjusted.

Figure 6:
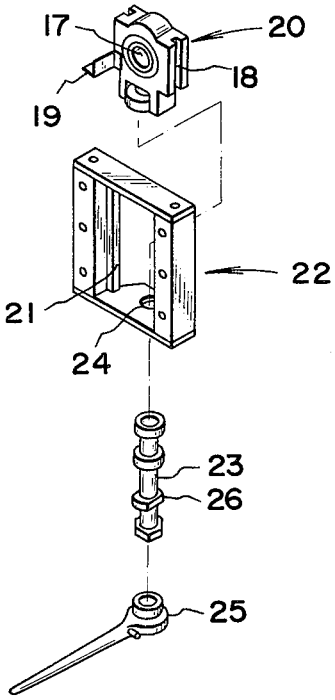
FIG. 6 is a fragmentary perspective view illustrating the bearing mechanism.

The structure of the bearing mechanism 16 will now be described by reference to FIG. 6.

The bearing mechanism 16 comprises a take-up type unit (block) 20 having a bearing portion 17, a groove 18 extending in the direction of the coating roller 7 (vertical direction) and an indicator 19 and a frame 21 having a guide rail 21 extending in the direction of the coating roller 7 (vertical direction) and fitted in the groove 18 of the take-up type unit 20. By this arrangement, the unit 20 is disposed movably in the frame 22 in the vertical direction. A screw shaft 23 is mounted on the unit 20 so that a male screw of the screw shaft 23 is engaged with a female screw 24 of the frame 22 to adjust the position of the unit 20. Namely, when the shaft 23 is turned by a wrench 25, the unit 20 can be shifted to an optional position.

The same bearing mechanism as the bearing mechanism 16 can be used as the bearing mechanism 14 except that the mechanism 14 is used in such a state that the groove 18 and guide rail 21 extend in the horizontal direction. The position of the bearing mechanism 14 may be fixed by clamping by means of a lock nut 26.

A pair of dam plates 28 are disposed at position very close to the side edge portions on both the coating roller 7 and press roller 11 to form an oil reservoir 27 on both the surfaces of the two rollers above the contact point of the two rollers (see FIGS. 2 and 4).

Figure 5:
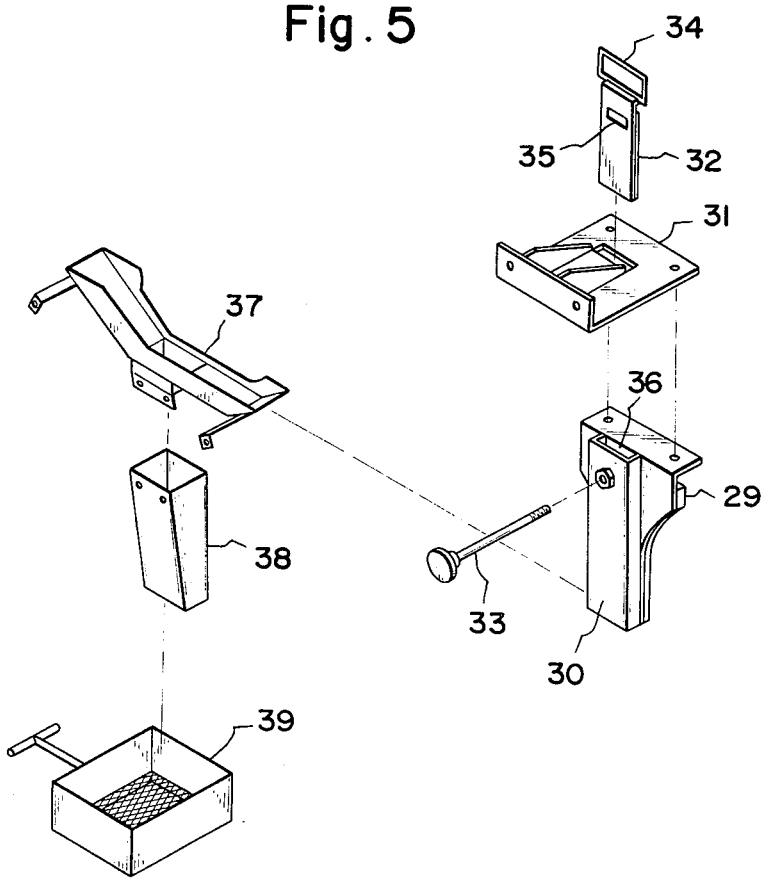
FIG. 5 is a fragmentary perspective view showing the mechanism illustrated in FIG. 4.

Referring to FIG. 5 illustrating in detail the structure of one dam plate 28, this dam plate 28 comprises a body 30 provided with a seal portion 29 for forming a liquid-tight seal between the two rollers 7 and 11, a bracket 31 for fixing the body 30 to the machine frame 1, an overflow plate 32 and a position-adjusting screw 33. The overflow plate 32 has a handle 34 and an opening 35 and is slidably kept in a concave portion or groove 36 formed on the body 30 to extend in the vertical direction. In this arrangement, the liquid level of the oil reservoir 27 formed on the surfaces of the rollers 7 and 11 can be freely adjusted by moving the overflow plate 32 in the vertical direction to change the position of the opening 35 in the vertical direction.

These dam plates 28 are brought close to the side edge portions of both the coating roller 7 and press roller 11 through the seal portions 29 by turning the position-adjusting screws 33, whereby secure liquid tightness can be maintained assuredly between the two rollers 7 and 11.

An oil receiving saucer 37 for receiving therein an overflowing oil is disposed below the discharge opening of the body 30, and the oil stored in the saucer 37 is introduced into an oil recovery tank 40 through a chute 38 and a filter 39.

An oil-feeding mechanism is disposed to feed an oiling composition to the above-mentioned oil reservoir 27. This oil-feeding mechanism comprises a tank 41 for containing therein an oiling composition, a conduit 42 laid out in the bottom portion of the tank 41 and an adjusting valve 43. The degree of opening of the valve 43 is adjusted by a handle 44 so as to feed an appropriate amount of the oiling composition to the oil reservoir 27. The oiling composition in the oil recovery tank 40 may be recycled to the oil tank 41 or oil reservoir 27 through a conduit 45.

A driving mechanism is disposed to drive the coating roller 7 and the feeding roller 15, optionally together with the press roller 11. An electric motor 45, a variable speed gear 46 and a reduction gear 47 are disposed for this driving mechanism. The output from the reduction gear 47 is transmitted to an output shaft 51 through a wheel 48, a V-belt 49 and a wheel 50. A sprocket 52 having the same diameter as that of the coating roller 7 is coaxially mounted on the coating roller 7, a sprocket 53 having the same diameter as that of the feed roller 15 is coaxially mounted on the feeding roller 15, and a sprocket 54 having the same diameter as that of the press roller 11 is coaxially mounted on the press roller 11. The sprockets 52 and 53 are engaged with a sprocket 55 fixed to the output shaft 51 through a chain 56 and the sprocket 54 is engaged with a sprocket 57 fixed to the output shaft 51 through a chain 58, whereby the rollers 7, 11 and 15 are driven at the same peripheral speed. Further, sprockets 59 and 60 are attached to the pulleys *3b* and *4a*, respectively, and these sprockets 59 and 60 are engaged with a sprocket 61 fixed to the output shaft 51 through a chain 62, whereby the belts 3 and 4 are driven at a speed synchronous with the speed of the rollers.

In the present invention, as the foam layers 10 and 13 of the coating roller 7 and press roller 11, there can be used foams of oil-resistant elastomers such as polyurethane, nitrile-butadiene rubber and polychloroprene. Foams of the open-cell structure are especially preferred. The extent of foaming is adjusted so that impregnation with an oiling composition is appropriately accomplished. In the present invention, it is preferred that the extent of foaming is 2 to 10 times, preferably 3 to 5 times.

As the sealing portions 29 of the dam plates 28 used for formation of the oil reservoir 27 of the rollers 7 and 11, there can be used the same foams as described above with respect to the foam layers of these rollers. It was quite a surprising finding that even when foams are used for these sealing portions 29, very good liquid tightness can be attained without abrasion of the seal portions 29 or the foam layers 10 and 13. The reason is considered to be that an oiling composition is incorporated into each of these foams to impart a lubricating effect to them.

When the apparatus of the present invention is applied to coating of an oiling composition to mats, the motor 45 is first started, and the speed change gear 46 is adjusted to drive each roller at a predetermined peripheral speed. An oiling composition is charged in the oil tank 41, and the valve 43 is opened to feed the oiling composition at a predetermined feed speed onto the engaging portion (the nip position) between the coating roller 7 and press roller 11 to form the oil reservoir 27.

A mat to be coated with an oiling composition is placed on the feeding table 2 so that a portion of fiber piles (fiber tufts) is located on the upper side and a portion of the backing layer is located on the lower side, and the mat is fed between the coating roller 7 and the feeding roller 15 by means of the belt 3.

The oiling composition in the oil reservoir 27 permeates into the form layer 10 of the coating roller 7 while it passes through the oil reservoir 27. The amount of the oiling composition permeating into the foam layer 10 at this point can optionally be changed by changing the degree of pressed contact between the coating roller 7 and press roller 11. Namely, in the bearing mechanism 14 illustrated in FIGS. 1 and 6, the adjusting screw 23 is turned in a certain direction to shift the unit 20 toward the coating roller 7 (namely, to the discharge side) and press the press roller 11 tightly against the coating roller 7, whereby the amount of the oiling composition permeating into the foam layer 10 can be relatively reduced. In contrast, when the adjusting screw 23 is turned in the reverse direction to shift the unit 20 in the opposite direction (namely, to the feeding side) and weaken the pressing action of the press roller 11 against the coating roller 7, the foam layer 10 of the coating roller 7 is impregnated with a relatively large amount of the oiling composition.

The oiling composition included in the foam layer 10 is squeezed out on the tuft fibers when the foam layer 10 is compressed to the fiber tuft portion of the mat fed between the coating roller 7 and feeding roller 15, and the fibers of the mat are coated with the oiling composition.

The coating roller 7 and feed roller 15 are disposed with a certain gap being formed therebetween, so that the coating roller 7 is prevented from having direct contact with the feeding roller 15, and accordingly, when a mat is not fed between the coating roller 7 and feeding roller 15, the oiling composition included in the foam layer 10 does not adhere or disperse to the feeding roller 15 or other surrounding units but is returned to the oil reservoir 27.

In the present invention, the amount of the oiling composition coated on the mat can be delicately adjusted by changing the above-mentioned gap between the coating roller and feeding roller 15. More specifically, in the bearing mechanism 16 illustrated in FIGS. 1 and 6, when the adjusting screw 23 is turned in a certain direction to shift the unit 20 toward the coating roller 7 (namely, in the upward direction) and the gap between both the rollers 7 and 15 narrowed, the amount of the oiling composition transferred to the mat, namely the coated amount, can be relatively increased. In contrast, when the adjusting screw 23 is turned in the reverse direction to shift the unit 20 in the opposite direction (namely, in the downward direction) and the gap between the two rollers 7 and 15 broadened, the amount of the oiling composition transferred to the mat, namely the coated amount, can be relatively decreased.

The mat having the tuft fibers coated uniformly with the oiling composition is discharged from the apparatus by the feeding roller 15 and discharge belt 4, and a product is obtained.

The oiling composition excessively fed to the oil reservoir 27 is recovered in the oil recovery tank 40 through the overflow opening 35 formed on the dam plate 28, the receiving saucer 37, the chute 38 and the filter 39. Fiber dusts and the like contained in the oiling composition are collected on the filter 39. The oiling composition in the oil recovery tank 40 is recycled to the oil tank 41 or the oil reservoir 27 as it is or after it has been subjected to an appropriate refining treatment.

In the present invention, in the case where the viscosity of the oiling composition is adjusted by the temperature, the liquid level control of the oil reservoir 27 is carried out by overflowing and the oiling composition is recycled to the oil tank 41 from the oil recovery tank 40, and then good results can be obtained. In this case, the temperature control of the oiling composition can be easily accomplished by a heating mechanism (not shown) disposed in the oil tank 41.

The liquid level control of the oil reservoir 27 may be accomplished by a method other than the abovementioned overflow method. For example, a level detector is disposed in the oil reservoir 27 and an electromagnetic valve or pneumatic valve is used as the adjusting valve 43, so that supply of the oiling composition is automatically started or stopped in response to a signal from the liquid level detector.

As will be apparent from the foregoing illustration, according to the present invention, by using a coating roller 7 having a foam layer 10 on the periphery thereof and by changing the degree of pressed contact between such coating roller 7 and a press roller 11 and the gap between the coating roller 7 and a feeding roller 15, it is made possible to coat an oiling composition uniformly in a controlled amount to fiber piles of a duster mat.

The amount of an oiling composition coated on a mat in the roller coating system is likely to vary depending on the viscosity of the oiling composition. In general, the amount coated of an oiling composition having a higher viscosity is larger than the amount coated of an oiling composition having a lower viscosity. Further, the viscosity of an oiling composition varies depending on the temperature. For example, when the same oiling composition is coated at temperatures ranging from 6° to 50° C. under the same coating conditions, the amount coated of the oiling composition varies in the range of from 16% by weight based on fibers (at 6° C.) to 5% by weight based on fibers (at 50° C.). According to the present invention, such difference of the coated amount owing to the difference of the kind of the oiling composition or the viscosity can be controlled, and the amount coated of the oiling composition can be roughly adjusted to a preferred level selected from a relatively broad range by adjusting the degree of press contact between the above-mentioned rollers 7 and 11. Further, delicate adjustment of the amount of the oiling composition to the fibers can be accomplished by adjusting the gap between the above-mentioned rollers 7 and 15. The reproducibility of this delicate adjustment is very high. An instance of this delicate adjustment of the coated amount by changing the gap between the rollers 7 and 15 is shown below.

| Gap (mm) between Rollers 7 and 15 | Coated Amount (% by weight based on fibers) |
|---|---|
| 3 | 6.9 |
| 4 | 6.1 |
| 5 | 5.5 |

As will be apparent from the foregoing illustration, when the coating apparatus of the present invention is employed, even if mats are intermittently fed, an oiling composition can be coated uniformly in a controlled amount without loss of the oiling composition. Further, the coating apparatus can be maintained and inspected very easily. Thus, various advantages can be attained according to the present invention.

What is claimed is:

1. An oil coater for mats which comprises a mat-supporting moving surface, a coating roller disposed above said mat-supporting moving surface and having on the periphery thereof a foam layer capable of being impregnated with an oiling composition, a press roller having a diameter smaller than the diameter of said coating roller and having on the periphery thereof a foam layer capable of being impregnated with an oiling composition, a first bearing mechanism which supports said press roller at a position upstream of said coating roller so that the top face of said press roller is substantially on the same horizontal plane with the top face of said coating roller and the degree of pressed contact between said coating roller and said press roller can be adjusted, a mat-feeding roller disposed below said mat-supporting moving surface, a second bearing mechanism which supports said feeding roller so that the axis of said feeding roller is substantially on the same vertical plane with the axis of said coating roller and the gap between said feeding roller and said coating roller can be adjusted, a pair of confronting dam plates arranged to form an oil reservoir on the surfaces of said coating roller and said press roller through seal portions above the contact position of said two rollers, an oil feed mechanism for supplying an oiling composition to said oil reservoir, a mechanism for controlling the level of the oiling composition in said oil reservoir and a driving mechanism for driving said coating roller and said feeding roller, wherein the amount of the oiling composition coated on the mat can be controlled by adjusting the degree of pressed contact between said coating roller and said press roller and the gap between said coating roller and said feeding roller wherein both of said foam layers and said sealed portions are composed of open-cell structure foams of an oil-resistant elastomer whereby liquid tightness is attained between said foam layers and said seal portions without abrasion of these materials.

2. An oil coater as set forth in claim 1 wherein each of said first and second bearing mechanisms comprises a take-up unit including a bearing portion, a groove extending in the direction of the coating roller and an indicator, a frame having a guide rail fitted in said groove and extending in the direction of the coating roller, and a screw shaft for adjusting the position of said unit.

3. An oil coater as set forth in claim 1 wherein each of said dam plates comprises a body having a seal portion forming a liquid-tight seal between said coating roller and said press roller, a bracket for fixing said body to a machine frame, an overflow plate slidably disposed in said body and having an opening, and a position-adjusting screw for adjusting the degree of pressing of said body to said rollers.

4. An oil coater as set forth in claim 1 wherein said oil-resistant elastomer is selected from the group consisting of polyurethane, nitrile-butadiene rubber and polychloroprene.

5. An oil coater as set forth in claim 4 wherein said foams have a foaming ratio of 2 to 10.

* * * * *